United States Patent [19]

Henkel

[11] Patent Number: 5,044,157

[45] Date of Patent: Sep. 3, 1991

[54] METHOD AND APPARATUS FOR ELIMINATING CARBON COLLECTED IN AN EXHAUST GAS FILTER OF AN INTERNAL COMBUSTION ENGINE

[75] Inventor: Dietmar Henkel, Neumarkt, Fed. Rep. of Germany

[73] Assignee: MAN Nutzfahrzeuge Aktiengesellschaft, Munich, Fed. Rep. of Germany

[21] Appl. No.: 420,268

[22] Filed: Oct. 13, 1989

[30] Foreign Application Priority Data

Oct. 13, 1988 [DE] Fed. Rep. of Germany ..... 3834920

[51] Int. Cl.[5] ..... F01N 3/02

[52] U.S. Cl. ..... 60/274; 55/466; 55/DIG. 30; 60/275; 60/303; 60/311

[58] Field of Search ..... 60/274, 275, 311, 303; 55/466, DIG. 30

[56] References Cited

U.S. PATENT DOCUMENTS 3,180,083 4/1965 Heller ..... 60/275
4,441,971 4/1984 Ishiguro ..... 60/275
4,829,766 5/1989 Henkel .

FOREIGN PATENT DOCUMENTS 2153134 5/1973 Fed. Rep. of Germany ..... 60/275
163111 10/1982 Japan ..... 60/275
11416 1/1986 Japan ..... 60/275

*Primary Examiner*—Douglas Hart
*Attorney, Agent, or Firm*—Robert W. Becker & Associates

[57] ABSTRACT

A method and apparatus for removing carbon that has been collected in an exhaust gas filter of an internal combustion engine utilizing electrical energy that is introduced via an appropriate electrode arrangement. In order to obtain a more homogeneous current flow and hence a greater (more rapid) burning of carbon without great expenditure, the thermal heating-up of the carbon is effected in exhaust gas conveying chambers and in the filter with the aid of an electrostatic alternating field that is induced between the electrodes and produces radially directed, axially equalized discharge currents, so-called shift currents.

7 Claims, 1 Drawing Sheet

METHOD AND APPARATUS FOR ELIMINATING CARBON COLLECTED IN AN EXHAUST GAS FILTER OF AN INTERNAL COMBUSTION ENGINE

BACKGROUND OF THE INVENTION

The present invention relates to a method of removing carbon from the exhaust gases of an internal combustion, especially a Diesel engine, including conveying the exhaust gases through the filter means of a carbon filter to remove the carbon, and burning the removed carbon during operation of the engine utilizing electrical energy that is introduced via an appropriate electrode arrangement. The present invention also relates to an apparatus for carrying out such a method.

One heretofore known method makes use of the electrical conductivity of the collected carbon (U.S. Pat. No. 4,829,766 issued May 16, 1989, to Dietmar Henkel, the applicant of the present application). With this known method, via a suitably shaped electrode pair which is in electrical contact with the carbon layer, an electrical voltage is impressed the result of which is a flow of current that serves to heat up the carbon to the ignition temperature. As a consequence of the negative temperature coefficient of the specific electrical resistance of the carbon, the electrical energy exchange at that location is locally inhomogeneously effected, i.e. the burn-out occurs in a slowly wandering, hot, linear zone. In order to obtain a large, active burn-out surface for the purpose of achieving a high burn-out rate, this known method requires several electrode pairs accompanied by simultaneous boundary regulation of the individual streams or a rapid switch-over of the hot stream to the individual electrode systems.

It is therefore an object of the present invention to achieve a more homogeneous current flow and hence a greater (more rapid) carbon burn-out without great complexity.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
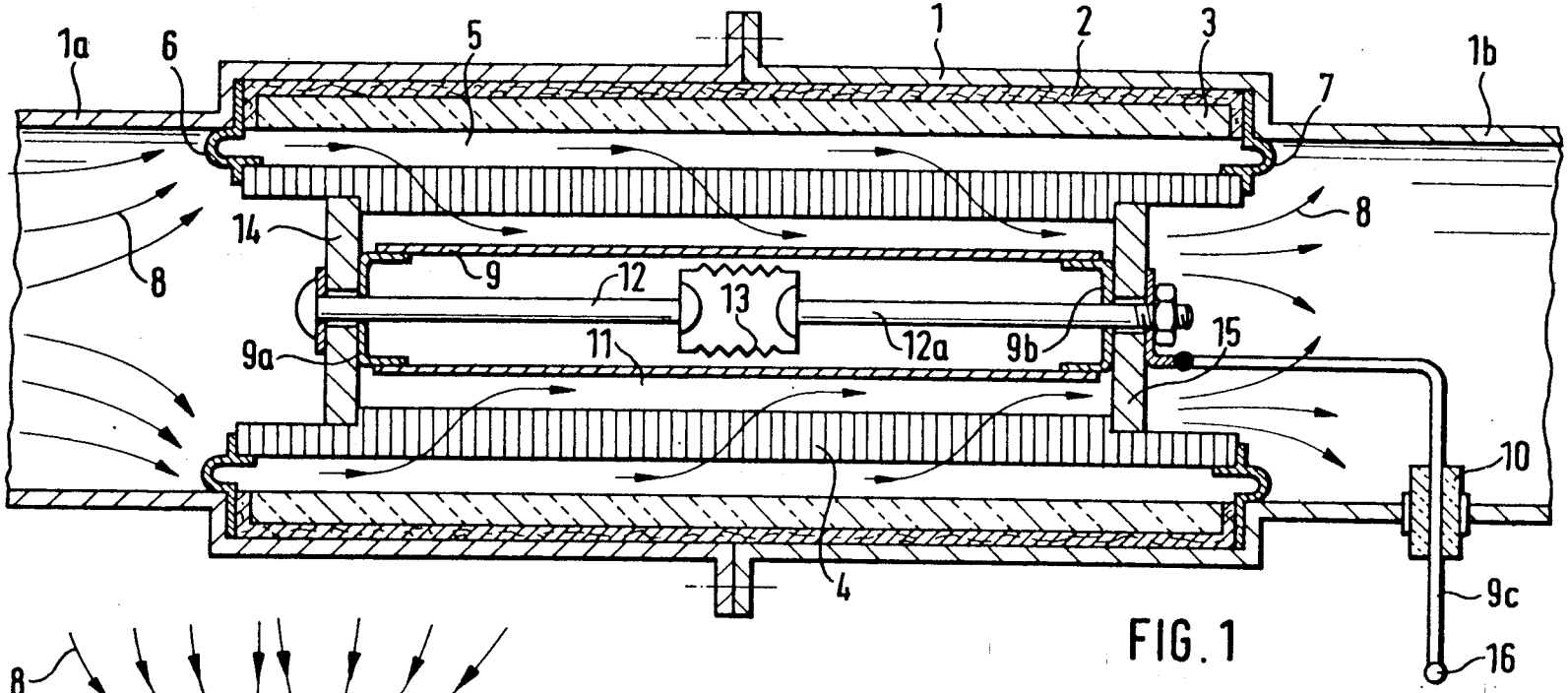
FIG. 1 is a longitudinal cross-sectional view through one exemplary embodiment of the inventive carbon filter.

The method of the present invention is characterized primarily by effecting thermal heating-up of the carbon in exhaust gas conveying chambers and the filter means with the aid of an electrostatic alternating field that is induced between the electrodes and produces radially directed, axially equalized discharge currents, so-called shift currents.

The thereby encountered discharge form of the locally homogeneously distributed electrical current generates, in addition to microelectric arcs in the filter means that heat up particles, in an opportune manner a partial conversion of the residual oxygen in the exhaust gas into ozone, which in turn serves for the spontaneous oxidation, in particular of the small carbon particles.

A further advantage resulting from the temperature independence of the inventive method is any desired placement of the filter downstream of the position of the exhaust gas collection tube. A displaceability into the vicinity of the end of the exhaust gas section (or beyond the motor space) signifies, due to the less critical requirements with regard to a space-saving accommodation at that location, a more generous structural configuration of the removal unit in conformity with its process objective.

The inventive apparatus for carrying out the method of the present invention includes a tubular, metallic filter having an inlet and outlet means for an exhaust gas stream, and a filter means, in the form of a tubular filter element of refractory material that is disposed in the filter housing and separates two exhaust gas carrying chambers (annular spaces) from one another, whereby carbon collected in the filter means is burned utilizing electrical energy that is introduced via an appropriate electrode arrangement disposed within and outside the tubular filter element. The inventive apparatus is characterized primarily by: as that electrode that is disposed outside the filter tube, an electrode that is embodied as a ground electrode and comprises a resiliently cushioning layer of metal fleece; an insulating member having a high relative dielectric constant, with the ground electrode serving as an intermediate layer to secure the insulating member (insulating tube) in place relative to the filter housing; and as that electrode that is disposed within the filter tube, an electrode that is embodied as a tubular member and functions as a high voltage conducting electrode.

The high dielectric constant of the insulating tube, while at the same time having a high electrical breakdown potential or dielectric strength, is advantageous because the field intensities in the dielectric layers of filter tube and exhaust gas conveying annular spaces are inversely proportional to the dielectric constants thereof. In the dielectric exhaust gas as well as filter tube, a field intensity is established that increases the higher is the dielectric constant of the material of the insulating tube. The greatest portion of the applied voltage is consequently converted in the desired manner into "operating field strength" in the exhaust gas conveying annular spaces as well as in the filter tube.

The shift current density, and hence also the accommodated total stream of the removal unit, which can be perceived as an electrical capacitor, is essentially a function of the capacitive alternating-current resistance of the insulating tube (determined by the selected wall thickness of the tube and the dielectric constant of the material thereof). Since this resistance for the discharge of currents acts not only in the exhaust gas conveying annular spaces but also in the filter tube like a current-limiting reactance that is connected in series, a degeneration of the so-called "quiet discharge" that exists at that location to an undesired linear spark discharge that combines the entire applied electrical current is reliably precluded.

A further desired effect of the insulating tube is the axial equalization of the shift current density, with the latter determining the local operating capacity such as the ozone yield and the microelectric arc formation between the particles in the region of the exhaust gas conveying annular spaces and the filter tube.

Further specific features of the present invention will be described in detail subsequently.

DESCRIPTION OF PREFERRED EMBODIMENTS

Referring now to the drawing in detail, shown in FIG. 1 is a filter housing 1 having inlet means 1*a* and outlet means 1*b*. Disposed in the filter housing 1 is a resilient cushioning intermediate layer 2 of metal fleece that at the same time functions as a ground electrode. With the aid of this intermediate layer 2, a subsequently disposed hollow cylinder 3 of insulating material (glass ceramic) is axially and radially secured in place relative to the filter housing 1.

Following the hollow cylinder 3 is the actual carbon-removal filter, which is embodied as the filter tube 4. The insulating tube 3 and the filter tube 4 are disposed coaxially relative to one another and form a first annular gap or space 5. The filter tube 4 is axially and radially fixed with the aid of resilient spacers 6 and 7 (for the compensation of the different thermal expansions between the filter housing 1 and the carbon-removal filter 4).

The spacer 6 is embodied in such a way that it only slightly obstructs the in-flow movement of the exhaust gas into the annular space 5 (see arrows 8 on the left side of FIG. 1); the spacer 6 comprises three narrow, strip spring elements that end on a circular disk and are staggered by 120° relative to one another in a circumferential direction. In contrast, the spacer 7 is embodied in such a way that it forms a nearly gastight end for the annular space 5, so that the exhaust gas stream is forced to flow through the porous, carbon-collecting wall of the filter tube 4. When selecting the material for the filter tube 4, care must be taken that materials are used that have a high insulating capability (no electrical conductivity) and as small a dielectric constant as possible.

Disposed in the central region of the cylindrical filter housing 1 is an electrode 9 that conducts high voltage and that is similarly embodied as a tubular member. Thus, a second annular gap or space 11 is disposed between the filter tube 4 and the electrode tube 9.

The ends of the tubular electrode member 9 are closed off in a cover-like manner via the cover means 9*a* and 9*b*. The ends of the electrode tube 9 are fixed via a lengthwise resilient tie rod system that comprises the two bolts 12 and 12*a* and a tubular bellows-type spring 13. The ends of the bolts 12, 12*a* are guided through central holes in the two electrode cover means 9*a* and 9*b*, in which connection it should be noted that one of the cover means must be axially displaceable (the cover means 9*a* in the illustrated embodiment) in order to be able to compensate for the temperature-related different expansions between the electrode 9 and the filter tube 4. At the same time, the bolts 12, 12*a* serve for the introduction of axial tension forces onto a front and rear spacer disk 14 and 15, both of which are made of a material having as small a dielectric constant as possible. In addition to assuming the mechanical centering function for the high volt age electrode 9, the spacer disk 14 also has a sealing function for the second annular space 11. In other words, the spacer disk 14 has no openings or channels as does the spacer disk 15, which, in a manner similar to the resilient spacer 6, should only slightly reduce the out-flow cross section of the annular space 11.

The high voltage potential (low frequency alternating-current voltage having a frequency of about 20 kHz and a voltage of 20 kV and greater) is applied to the electrode 9 over a lead 9*c* via a high voltage connection 16 and an insulator 10.

The carbon is removed in the following manner:

A ground-referenced alternating-current voltage having a frequency of about 20 kHz and a voltage of 20 kV and greater is applied to the cylindrical high voltage electrode 9 via the lead 9*c*, which has a low corona loss or discharge and is electrically insulated relative to the filter housing 1 via the insulator 10. A radially directed electrical field is formed between the high voltage electrode 9 and the ground electrode 2 of metal fleece. Due to the high dielectric constant of the insulating tube 3 (the thickness of which is to be kept to a minimum, i.e. in conformity with the radial field intensity distribution should just withstand an electrical disruptive discharge or arc-through), as well as the low dielectric constant of the tubular filter member 4, (for the time being disregarding the different thicknesses of the layers formed by the glass tube 3, the exhaust gas conveying annular space 5, the filter tube 4, and the exhaust gas conveying annular space 11), there results, due to the inversely proportional relationships of the resulting electrical field intensities to the respectively associated dielectric constants of the field spaces, an advantageously high operating field strength not only in the exhaust gas conveying annular spaces 5 and 11, but also in the carbon-collecting filter tube 4 itself.

Figure 2:
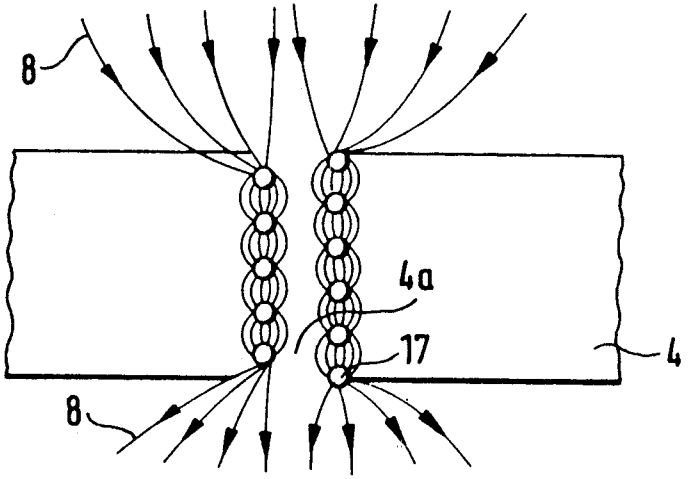
FIG. 2 is an enlarged partial cross-sectional view of the filter tube of FIG. 1 against which the exhaust gas flows, with this figure explaining the electrical occurrence in a capillary passage of the filter.

To the extent that, taking into consideration the aforementioned such a geometrical configuration of the individual layers is selected that at a sufficiently high line voltage, the disruptive electric field strength or dielectric strength of the exhaust gas in the carbon-removal tube 4 and in the two exhaust gas conveying annular spaces 5 and 11 is greatly exceeded, the following occurs: in the annular spaces 5 and 11 and also in the filter tube 4, an electrical discharge prevails that converts portions of the residual oxygen of the engine exhaust gas that comes from the engine and enters the annular space 5, see also the arrows 8, into ozone. This ozone advantageously oxidizes in particular carbon particles having an extremely small diameter and that are not removed by the filter (i.e. are not completely retained in the porous structure of the filter). The remaining carbon particles 17 (of greater diameter), as they pass radially through the filter tube 4, are deposited on the capillary passage-inner walls 4*a* of the expanded glass (the foamed ceramic). This is clearly shown, for example, in the enlarged scale drawing of FIG. 2. Due to the very high field intensity in the removal wall, shortly before the conductivity bridges are formed between the particles (contact of the themselves electrically conductive carbon particles), there occurs such a line of force concentration in the vicinity of the particle collection, especially however between the particles themselves, that the (capacitive) shift current density that is to be encountered achieves orders of magnitude that eventually lead to microelectric arcs between the individual particles, which due to their conductivity act like electrodes. The bases of the electric arcs, which respectively end on a carbon particle, assure a localized heating-up that is limited to the particle itself and that in the presence of oxygen, and especially ozone, leads to a spontaneous conversion into $CO_2$. In an advantageous manner, the hydrocarbons that are deposited in a film-like manner on the carbon particles similarly oxidize.

A prerequisite for a reliable removal action by the filter 4 is an electrical proportioning that assures a very high basic value of the shift current density within the (not loaded with carbon) pertaining wall of the filter 4. At the same time, the design strength should be greater than the dielectric strength of the engine exhaust gas. In this connection, it is easy to influence the field intensity in the filter wall 4 via the magnitude of the alternating-current voltage applied to the tubular body of the high voltage electrode 9; in contrast, the shift current density is appropriately provided by selection of a sufficiently high frequency for the alternating-current voltage.

The degree of carbon removal can, of course, be identified by observing the energy current consumption of the removal unit (at a low frequency of the feed voltage and hence lower energy consumption), in order to undertake the electrical power supply via increase of the frequency and possibly increasing the feed voltage to its rated voltage only after a finite quantity of particles have been removed.

It should finally be noted with regard to the configuration of the removal chamber, it is also possible to use geometrical arrangements for the removal unit that deviate from the shape of the annular space (for example plate elements that are combined into a stack in a sandwich-like manner, and that promise a good utilization of space with regard to the cross-sectional area through which flow occurs).

The present invention is, of course, in no way restricted to the specific disclosure of the specification and drawing, but also encompasses any modifications within the scope of the appended claims.

What I claim is:

1. In a method of removing carbon from the exhaust gases of an internal combustion engine, especially a Diesel engine, including conveying said exhaust gases through the filter means of a carbon filter to remove said carbon, and burning the removed carbon during operation of said engine utilizing electrical energy that is introduced via an electrode arrangement, the improvement including the step of:

effecting thermal heating-up of said carbon in exhaust gas conveying chambers and said filter means with the aid of an electrostatic alternating field that is induced between said electrodes and produces radially directed, axially equalized discharge shift currents.

2. In an apparatus for removing carbon from the exhaust gases of an internal combustion engine, especially a Diesel engine, including a tubular, metallic filter housing having an inlet and outlet means for an exhaust gas stream, and a filter means, in the form of a tubular filter element of refractory material that is disposed in said filter housing and separates two exhaust gas conveying chambers from one another, whereby carbon collected in said filter means is burned utilizing electrical energy that is introduced via an appropriate electrode arrangement disposed within and outside said tubular filter element, the improvement comprising:

an electrode that is disposed outside said filter tube, said electrode being embodied as a ground electrode and comprises a resiliently cushioning layer of metal fleece;

an insulating member having a high relative dielectric constant, with said ground electrode serving as an intermediate layer to secure said insulating member in place relative to said filter housing; and an electrode that is disposed within said filter tube, said electrode being embodied as a tubular member and functions as a high voltage conducting electrode.

3. An apparatus according to claim 2, which includes external resilient spacers and inner spacer disks for fixing said filter tube in said filter housing.

4. An apparatus according to claim 3, in which one of said resilient spacers is disposed on an exhaust gas inflow side and merely comprises three strip spring elements that are staggered by 120° from one another in a circumferential direction and that end in a common circular disk for disposition against said filter housing.

5. An apparatus according to claim 3, in which one of said spacer disks is disposed on an exhaust gas outflow side and is provided with openings.

6. An apparatus according, to claim 5, which includes a lengthwise resilient tie rod system that is supported by said spacer disks and centers said inner electrode.

7. An apparatus according to claim 2, in which said exhaust gas conveying chambers are annular spaces, said insulating member is an insulating tube, said layers of insulating tube, filter tube, and annular spaces have thicknesses that are coordinated with one another, and said insulating tube has a dielectric constant of about 10.

* * * * *